US005626512A

United States Patent [19]

Palaikis et al.

[11] Patent Number: 5,626,512

[45] Date of Patent: May 6, 1997

[54] SCOURING ARTICLES AND PROCESS FOR THE MANUFACTURE OF SAME

[75] Inventors: Liana V. Palaikis, Woodbury; Gary L. Olson, Shoreview; Rufus C. Sanders, Jr., Burnsville, all of Minn.

[73] Assignee: Minnesota Mining and Manufacturing Company, St. Paul, Minn.

[21] Appl. No.: 434,612

[22] Filed: May 4, 1995

[51] Int. Cl.[6] ..... B24D 11/02

[52] U.S. Cl. ..... 451/536; 451/532; 15/209.1; 15/226; 51/298

[58] Field of Search ..... 451/532, 533, 451/536, 537; 51/297, 298; 15/226, 209.1, 208

[56] References Cited

U.S. PATENT DOCUMENTS

| | | |
|---|---|---|
| 2,958,593 | 11/1960 | Hoover et al. . |
| 3,104,426 | 9/1963 | Wellman . |
| 3,410,034 | 11/1968 | Snyder . |
| 3,500,504 | 3/1970 | Oguchi et al. . |
| 3,626,552 | 12/1971 | Walker et al. . |
| 3,633,352 | 1/1972 | Marriner . |
| 3,736,625 | 6/1973 | Johns . |
| 3,895,417 | 7/1975 | Zimmerman, Jr. . |
| 4,078,340 | 3/1978 | Klecker et al. . |
| 4,227,350 | 10/1980 | Fitzer . |
| 4,357,793 | 11/1982 | Gasser et al. . |
| 4,652,275 | 3/1987 | Bloecher et al. . |
| 4,700,538 | 10/1987 | Varga et al. . |
| 4,799,939 | 1/1989 | Bloecher et al. . |
| 4,991,362 | 2/1991 | Heyer et al. . |
| 5,025,096 | 6/1991 | Chiu et al. . |
| 5,025,596 | 6/1991 | Heyer et al. . |
| 5,082,720 | 1/1992 | Hayes . |
| 5,123,280 | 6/1992 | Baechler . |
| 5,165,979 | 11/1992 | Watkins et al. . |
| 5,316,837 | 5/1994 | Cohen . |
| 5,363,604 | 11/1994 | Heyer ..... 451/536 |
| 5,366,800 | 11/1994 | Johnson . |

FOREIGN PATENT DOCUMENTS

| | | |
|---|---|---|
| 0397374 | 11/1990 | European Pat. Off. . |
| WO94/04737 | 3/1994 | WIPO . |

OTHER PUBLICATIONS

Encyclopedia of Chemical Technology 3rd Edition, by Kirk–Othmer, 1982, vol. 17, pp. 384–399.

Database WPI Section Ch, Week 9228 Derwent Publications Ltd., London, GB; Class A28, AN 92–228521 XP002009454 & JP,A,04 146 082 (Kanai H) May 20, 1992.

*Primary Examiner*—Bruce M. Kisliuk
*Assistant Examiner*—Eileen Morgan
*Attorney, Agent, or Firm*—Gary L. Griswold; Walter N. Kirn; Daniel R. Pastirik

[57] ABSTRACT

Lofty, low density nonwoven pads and a process for the manufacture of such pads are described. The pads of the invention each comprise a bundle of discontinuous fibers bonded to one another at their mutual points of contact. The fibers are arranged within the bundle to provide a dense longitudinal central portion extending to opposite ends of the bundle, less dense side portions, a longitudinal tensile strength and a transverse tensile strength, wherein the longitudinal tensile strength is greater than the transverse tensile strength. The pads are made according to a process comprising forming a tow of discontinuous fibers so that the fibers are arranged within the tow to extend along a first axis, twisting the tow along the first axis to form a slubbed tow, bonding the fibers to one another at their mutual contact points and cutting the slubbed tow into scouring pads and the like.

12 Claims, 3 Drawing Sheets

SCOURING ARTICLES AND PROCESS FOR THE MANUFACTURE OF SAME

The present invention relates to scouring articles suitable for cleaning, scouring, polishing and other surface conditioning applications, to a process for the manufacture of such articles and to articles made by that process.

BACKGROUND OF THE INVENTION

The use of scouring pads in cleaning applications is well known, and nonwoven articles have been found useful in the manufacture of such pads. Scouring articles such as hand pads and the like are available in any of a variety of shapes and sizes and can comprise a number of different materials. Known scouring articles include those made of steel wool, for example, as well as those made of one or more natural or synthetic fibers.

Conventional nonwoven articles are made by first forming a lofty web of randomly oriented discontinuous fibers which may be tensilized and crimped by prior treatment. Such webs may comprise synthetic or natural fibers as well as combinations of fibers to provide a nonwoven article useful in cleaning, scouring and other surface conditioning applications. Nonwoven webs are typically formed as air laid webs on conventional equipment and are treated with a resinous binder to bind the web fibers to one another at their contact points. Abrasive particles can be added to the binder to impart an abrasive character to the finished article for more aggressive scouring applications, for example. One successful commercial product comprising such a nonwoven web is that sold under the trade designation "Scotch-Brite" by the Minnesota Mining and Manufacturing Company of St. Paul, Minn. Low density abrasive products of this general type can be prepared by the method disclosed by Hoover et al. in U.S. Pat. No. 2,958,593.

Although nonwoven articles like those described above have enjoyed considerable success, their manufacture requires the purchase and use of expensive, complex and bulky web forming equipment. To provide a consistent and uniform appearance and structure, nonwoven webs are made using a complex multi-step layering process which orients the discontinuous fibers within each layer of the web at an angle to the web output. The layering method, however, can result in cyclic inconsistencies in the form of down line folds and web edges running at the same angle width to the web output.

Other approaches to the manufacture of scouring articles include use of continuous filaments in the manufacture of a nonwoven web. The patent literature describes the use of continuous fibers in the formation webs and mats. Exemplary scouring articles made of continuous filaments are those described in U.S. Pat. Nos. 4,991,362 and 5,025,596 to Heyer et al. These patents describe low density abrasive articles formed with continuous, unidirectional crimped filament tow with the filaments bonded together at opposing ends of the pad. Although the articles of the '362 and '596 patents have enjoyed significant commercial success as kitchen scouring pads, some shortcomings have been noted. For example, the pads of the aforementioned patents include only monodenier continuous filament, and the method for the manufacture of these pads allows for little control of the loft of the finished pad other than through the careful selection of fiber properties (e.g., crimp, feedstock grade, heat-seal character). Moreover, equipment is required for the formation of substantially identical bond areas or seals at opposite ends of the pads to thereby bind the continuous fibers of the pads and maintain the structural integrity of the pads prior to the application of a binder.

In light of the foregoing, it is desirable to provide an open, lofty nonwoven article which is easily and economically manufactured and which can be used in any of a variety of applications such as a kitchen scouring pad, for example. It is desirable to provide such an article with a consistent and uniform structure made from a nonwoven web comprising discontinuous fibers and which can easily be provided with considerable loft without requiring the aforementioned bonding or sealing equipment to bond opposing ends of the pad during the manufacturing process. It is also desirable to provide a process for the manufacture of such articles which avoids the aforementioned cyclic inconsistencies while allowing for variations in the manufacturing conditions such as the use of blends of different fiber materials as well as blends of fiber deniers. It is desirable to provide such a process for the manufacture of low density nonwoven articles having a desired loft which is not entirely dependent on the properties of the fibers used.

SUMMARY OF THE INVENTION

The present invention provides lofty, low density nonwoven pads which can be easily and economically manufactured and which are suitable for a variety of uses, such as hand-held kitchen scouring pads (hereinafter "hand pads"), for example. The articles of the invention comprise a multi-layered lofty, low density construction made by a process which avoids forming the aforementioned folds or transverse web edges, thereby avoiding the cyclic inconsistencies known to those in the nonwoven art.

In one aspect, the invention provides an article useful in cleaning, scouring, polishing and other surface conditioning applications, comprising:

a bundle of discontinuous fibers bonded to one another at points of mutual contact, said fibers arranged within said bundle to provide a dense longitudinal central portion extending to opposite ends of said bundle, less dense side portions, a longitudinal tensile strength and a transverse tensile strength, wherein the longitudinal tensile strength is greater than the transverse tensile strength.

In addition to the aforementioned distribution of fibers, the fiber mass and loft within the bundle are arranged to be greatest along the first axis and to progressively decrease in a direction extending away from the first axis along a perpendicular second axis. The fibers preferably comprise an extruded thermoplastic polymer or a combination of two or more such polymers and may comprise melt bondable fibers (e.g., polyolefins). The fibers may be bonded to one another by a hardened resinous binder or by melt bonding, for example. Fibers may be crimped or uncrimped, but the preferred fibers are crimped and have a break strength of at least about one gram per denier to provide strength for scouring and like operations. Fiber deniers can vary but most preferably will be within a preferred range from about 1.5 to about 400 denier. For hand scouring pads, fiber deniers will preferably range from about 6 to 200. The above described articles are sufficiently coarse to be used as scouring pads. However, the articles may also include abrasive particles adhered to the fibers of the bundle by the resinous binder to provide additional abrasiveness for more aggressive scouring or other surface treatment applications.

In the description of the various features of the invention, certain terms will be understood to have the meanings set forth herein. The terms "fibers" and "filaments" are used interchangeably and refer to threadlike structures comprising natural or synthetic materials as further specified herein. "Tow" means a rope-like collection of discontinuous fibers wherein individual fibers are intermingled or tangled with adjacent fibers while the majority of the fibers are arranged to extend longitudinally along a first axis (e.g., the longitudinal axis of the tow). "Slubbed tow" means a tow which has been twisted around the foregoing first axis. "Discontinuous", as used in referring to the fibers herein, means cut fibers or staple fibers as those terms are normally used in the art. "Bundle" refers to a collection of fibers comprising a portion of slubbed tow. "Bonded" or "bonding", as used in referring to the connection of fibers within articles of the invention, means that the fibers have been subjected to conditions causing them to adhere to one another.

In another aspect, the invention provides a process for the manufacture of articles useful in cleaning, scouring, polishing and other surface conditioning applications, comprising:

forming a tow of discontinuous fibers arranged to extend along a first axis;

twisting said tow around said first axis to form a slubbed tow;

bonding said fibers to one another at their points of mutual contact; and cutting said slubbed tow to provide the article.

In this aspect of the invention, the providing step comprises the initial forming of a web of discontinuous fibers. The fibers of the web are then arranged to extend along the first (e.g., longitudinal) axis so that the fiber density, the fiber mass and the loft of the tow preferably are greatest along the first axis and progressively decrease along a second axis perpendicular to the first axis. Twisting is accomplished by rotating the tow about the first axis thereof. Preferably, the tow is twisted about 1800 per each 30.5 cm (12 in.) segment of the tow, but twisting more or less than 1800 per 30.5 cm segment will also provide suitable articles according to the present invention. The fibers used in the described process include the fibers described above, and, depending on process conditions and the nature of the fibers used, the fibers may be bonded to one another by melt bonding and/or by applying a coatable adhesive resin composition to the fibers and thereafter hardening the coatable composition (e.g., by curing) to bond the fibers at their mutual contact points. Hardening of the coatable composition is preferably accomplished by heat curing.

In still another aspect of the invention, articles made by the foregoing process are provided.

The additional details of the invention will be more fully appreciated by those skilled in the art after a consideration of the remainder of the disclosure including the detailed description of the preferred embodiment and the claims.

BRIEF DESCRIPTION OF THE DRAWINGS

In describing the preferred embodiment of the invention, reference is made to the various Figures, wherein.

DETAILED DESCRIPTION OF THE PREFERRED EMBODIMENT

Figure 1:
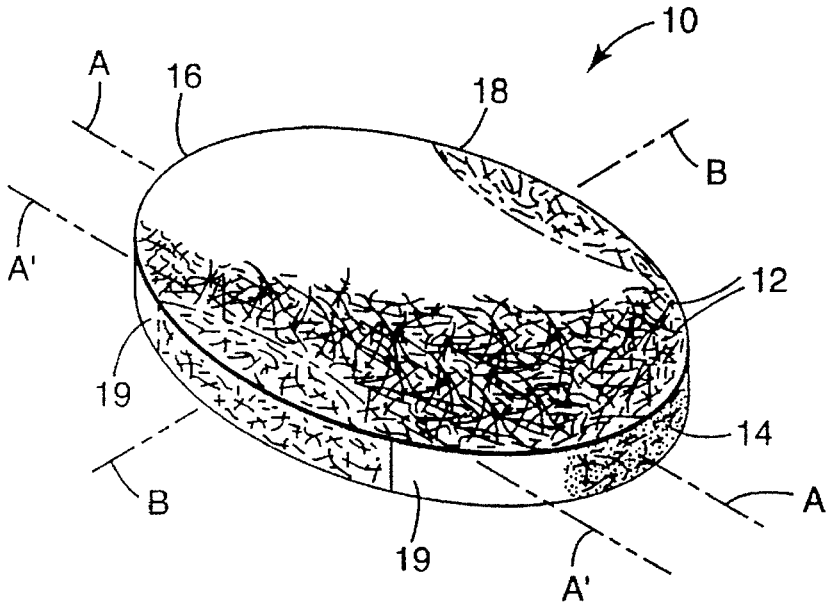
FIG. 1 is a perspective view of an article according to the present invention suitable for scouring and other surface finishing applications.

The details of the preferred embodiment of the invention will now be described with reference to the various Figures whenever appropriate. In describing the details of the preferred embodiment, various features of the described embodiment are identified in the drawings by reference numerals wherein like reference numerals indicate like structures.

An article made according to the present invention is illustrated in FIG. 1 as a hand pad 10, suitable for use in kitchen cleaning applications for example. The pad 10 comprises a bundle or portion of a slubbed tow of discontinuous fibers 12 bonded to one another at their mutual points of contact. A first axis, dotted line A—A, is shown extending through the central portion of pad 10 and shall be understood to be coextensive with the longitudinal axis of the slubbed tow (e.g., extending in the machine direction) from which the pad 10 was cut. Fibers 12 are preferably bonded to one another by a hardened resinous binder, as described herein. However, it is contemplated that melt bonding of fibers 12 can also be employed, either alone or in conjunction with a resinous binder, by the inclusion of suitable melt bondable fibers within the aforementioned slubbed tow.

Individual fibers 12 within pad 10 are intermingled or tangled with adjacent fibers. However, the fibers 12 are preferably arranged within the pad 10 to extend along the first axis A—A such that the longitudinal tensile strength along the axis A—A is greater than the lateral tensile strength along a laterally extending perpendicular second axis shown as the dotted line B—B. Preferably, the longitudinal tensile strength of the pad 10 along the axis A—A will be at least twice that of the lateral tensile strength along the second axis B—B. In hand scouring pads, for example, the ratio of the tensile strength along the first axis A—A to the tensile strength along the second axis B—B will typically be greater than 3 and can be as high as 7 or greater, depending on the materials used and the exact process conditions employed in the manufacture of the pad 10.

Figure 2:
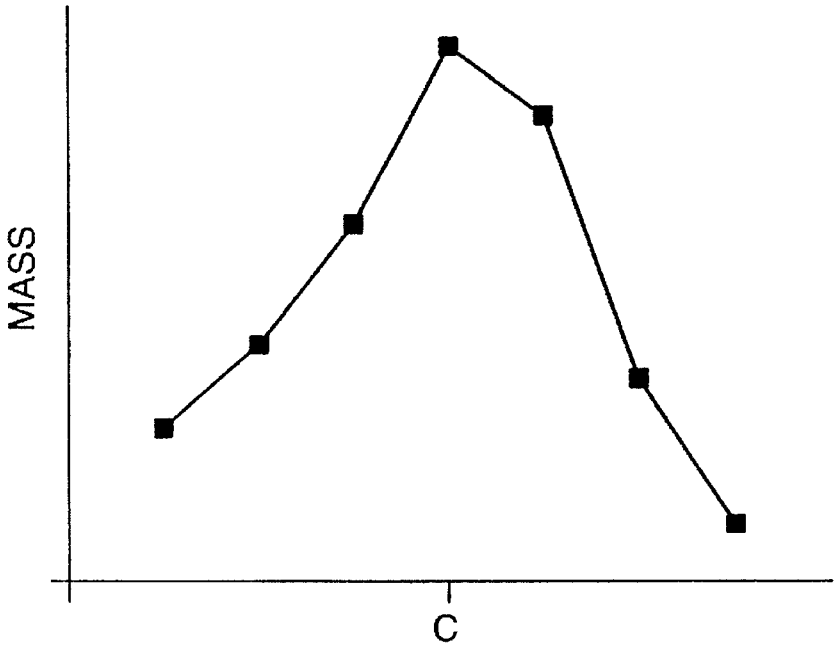
FIG. 2 is a graphic representation of the distribution of fiber mass across a scouring article made according to the present invention.
Figure 3:
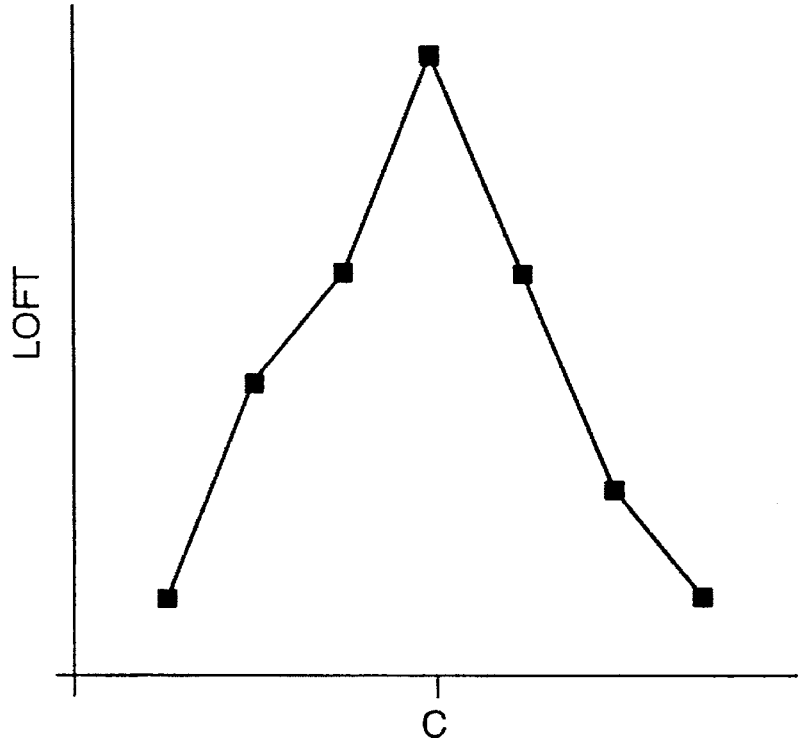
FIG. 3 is a graphic representation of the distribution of fiber loft across a scouring article made according to the present invention.

The fibers 12 are arranged in a distribution within the pad 10 so that fiber density, fiber mass and fiber loft are greatest along the central portion of pad 10 along the first axis A—A and progressively decrease in a direction extending laterally away from the axis A—A along the second axis B—B, thereby forming less dense side portions along the sides 18 and 19. In a hand pad, for example, the mass or the density of a cut strip of the pad 10 having a width of about 1.0 cm and centered along the axis A—A will typically be at least about 1.5 times greater than the mass or density of a comparable strip centered along a parallel line A'—A' near the edge 19 of pad 10. Additionally, the loft of the articles of the invention (not shown) will likewise be distributed with the loft of a strip of the pad 10 having a width of about 1.0 cm and centered along the first axis A—A being greater than the loft of a comparable strip of the pad centered along parallel line A'—A'. Exemplary mass and loft distributions for articles according to the invention are illustrated in FIGS. 2 and 3, respectively, with maximum loft and mass values indicated as occurring along the central portion "C" of the pad which shall be understood as corresponding to a strip of the pad 10 centered about the axis A—A.

As a result of the arrangement of fibers 12 along the axis A—A, the opposite edges 14 and 16 of the pad 10 comprise cut fiber ends which can be observed by close visual inspection and can be manually detected by the application of finger pressure, for example, against either or both of the edges 14 or 16. The above described distributions of the density, mass and fiber loft contribute to provide a conformable hand pad or like article having areas of high density in the centermost portion of the article. These center portions or areas of high density possess high internal strength and are suitable for use on high surface area work spaces. The less dense edges of the article will provide a desired degree of flexibility for use in tighter or more confined work areas (e.g., comers) as well as on curved surfaces. Of course, the actual mass, density or loft distribution for a hand pad or other article of the invention will vary depending on the specific fibers used and the conditions employed in the manufacturing process, and those skilled in the art will appreciated that the invention is not to be limited in any way to any specific distribution of the foregoing properties within an article such as a hand pad or the like. Although the pad 10 is shown to have a somewhat elliptical shape, it will be understood that the articles of the present invention can be provided in any of a variety of shapes and sizes including, without limitation, circular, elliptical, quadrangular, triangular and the like.

Discontinuous filaments useful in the present invention may be selected from synthetic fibers as well as naturally occurring fibers. Preferred synthetic fibers are extruded organic thermoplastic polymeric materials and, most preferably, are thermoplastic materials having a break strength of at least 1 gram per denier to provide the necessary degree of toughness for prolonged use as a scouring article. Exemplary of such preferred thermoplastic materials are filament-forming polymers including polyamides such as polycaprolactam (nylon 6) and polyhexamethylene adipamide (nylon 6,6), polyolefins such as polypropylene and polyethylene, polyesters such as polyethylene terephthalate and the like. Other useful filaments include naturally occurring fibers such as those made from cotton, rayon, kenaf, cellulose, as well as ceramic and metallic-based filaments, for example. Useful filaments can range from about 1.5 denier to about 400 denier and for kitchen scouring pads preferably from about 6 to about 200 denier. The filaments may be circular, multilobal, hollow, channeled or multi component (e.g., sheath core) in cross-section. Bicomponent fibers (including melt bondable constructions), filled and precoated filaments are also useful. Blends of two or more of the aforementioned useful fibers can also be used in the articles of the invention by combining the selected filaments in ratios ranging from 0 to 100% of any individual filament type. Suitable bicomponent melt bondable fibers include those described in U.S. Pat. No. 5,082,720 to Hayes et al., the disclosure of which is incorporated by reference herein. Additionally, blends of different fiber properties such as denier, tenacity, crimp, as well as blends of different fiber lengths may be advantageously used in the manufacture of the articles of the invention.

The discontinuous fibers may be crimped or uncrimped but preferably at least a portion of the fibers are crimped. The crimping of fibers may be accomplished by conventional methods such as by the use of a stuffer-box, gear crimpers or the like. The degree of crimping will preferably range from 0 to 10 crimps per centimeter (0 to 25 crimps per inch). Fiber lengths suitable for use in the invention will include all fiber lengths which can be processed in the manner described below. Because of commercial availability and ease of processing, preferred fiber lengths will range from 1.3 to 12.7 centimeters (0.5 to 5.0 inches).

As mentioned, a binder may be applied to bond the fibers of the article to one another. The binder is applied as a coatable composition which is subsequently hardened (e.g., by curing at elevated temperatures) to provide a finished article wherein the component fibers are suitably bonded to one another without residual tackiness. The binder may be selected from any suitable adhesive binder available to those skilled in the art. The binder may be a thermoplastic or a thermosetting resin and, preferably, is a thermosetting resinous adhesive. Resinous adhesives suitable for use in the present invention include phenolic resins, aminoplast resins having pendant $\alpha,\beta$-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorine-modified epoxy resins and combinations of the foregoing. Catalysts and/or curing agents may be added to the binder precursor to initiate and/or accelerate the polymerization process.

Preferably, the adhesive materials used in the present invention are phenolic resins such as resole and novolac resins described in Kirk-Othmer, *Encyclopedia of Chemical Technology,* 3d Ed., John Wiley & Sons, 1982, New York, Vol. 17, pp. 384–399, incorporated by reference herein. Resole phenolic resins are made with an alkaline catalyst and a molar excess of formaldehyde, typically in a mole ratio of formaldehyde to phenol between 1.0:1.0 and 3.0:1.0. Novolac resins are prepared under acid catalysis with a molar ratio of formaldehyde to phenol less than 1.0:1.0. Commercially available resins suitable for use in the present invention include those available under the trade designations "DUREZ" and "VARCUM," available from Occidental Chemicals Corporation (North Tonawonda, N.Y.); "RESINOX" available from Monsanto Corporation; and "AROFENE" and "AROTAP," both available from Ashland Chemical Company. A typical coatable resole resin useful in the manufacture of articles of the present invention contains between about 1.0% (by weight) and about 2.5% free formaldehyde, between about 1.0% and about 2.5% free phenol, between about 65% and 75% solids with the remainder water. The viscosity of the coatable resin is typically between about 1000 and about 3000 centipoise, as measured on a Brookfield model LVF viscometer at 25° C. (no. 4 spindle at 60 rpm). A preferred resin for use in the articles of the invention is a phenolic resin as described above prepared as a resole precondensate of a 2:1 molar ratio of formaldehyde:phenol in water with sodium hydroxide or potassium hydroxide catalyst.

The articles of the invention may optionally be provided with a more aggressive scouring surface by adhering abrasive particles to the filaments 12 in a known manner such as by the use of the aforementioned resinous adhesive binder. The abrasive particles used in making articles according to the present invention include all known abrasive materials as well as combinations and agglomerates of such materials. In applications where aggressive scouring or other end uses are not contemplated or desired, softer abrasive particles (e.g., those having a Mohs' hardness in the range between 1 and 7) can be applied to the resin to provide the finished article with a mildly abrasive surface. Suitable soft abrasives include, without limitation, inorganic materials such as flint, silica, pumice, and calcium carbonate as well as organic polymeric materials such as polyester, polyvinylchloride, methacrylate, methylmethacrylate, polycarbonate, and polystyrene as well as combinations of any of the foregoing materials. Harder abrasive materials (e.g., having a Mohs' hardness greater than about 8) can also be included within the articles of the invention to provide a finished article having a more aggressively abrasive surface. Suitable hard abrasives include, without limitation, aluminum oxide including ceramic aluminum oxide, heat-treated aluminum oxide and white-fused aluminum oxide; as well as silicon carbide, alumina zirconia, diamond, ceria, cubic boron nitride, garnet, and combinations of the foregoing. It is contemplated that the abrasive layer could include abrasive agglomerates such as those described in U.S. Pat. Nos. 4,652,275 and 4,799,939, the disclosures of which are incorporated herein by reference. The average particle sizes of the foregoing abrasives can range from about 4.0 to about 300 microns. When the articles of the invention are to be used manually (e.g., as hand pads), preferred particle sizes for the abrasive particles will be less than the average diameter of the filaments used in the aforementioned articles.

Other known ingredients may be included within the articles of the invention, as known to those skilled in the art. For example, pigments, fillers, lubricants, wetting agents, surfactants, antifoaming agents, dyes, coupling agents, plasticizers, suspending agents, antistatic agents, and the like. Detergents or soaps may also be coated over or otherwise applied to the articles of the invention in a known manner.

Figure 4:
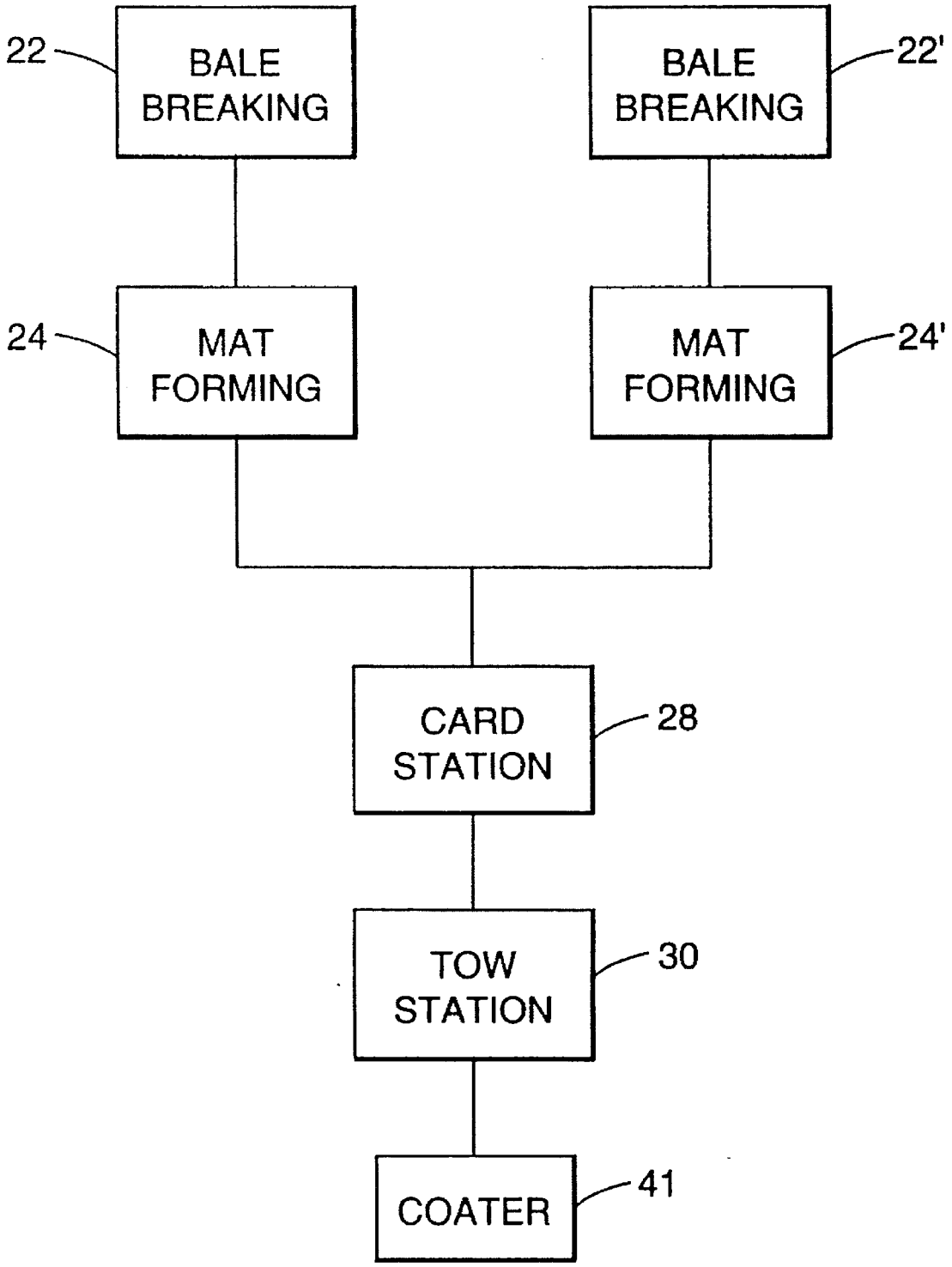
FIG. 4 is a block diagram representation of a process for the manufacture of articles according to the invention.

FIG. 4 depicts, in schematic, a process for the manufacture of articles according to the present invention. As known by those skilled in the nonwovens and textiles art, the manufacturing process typically starts with baled fibers. Through processing, the fibers are converted into a flat mat-like web which is further converted into a slubbed tow. The tow is treated to bind the fibers together and the thus treated tow is cut into finished articles, described above.

Initially, baled discontinuous and preferably crimped fibers are loosened for initial handling either by hand or, more preferably, by machine. Most preferably, the initial loosening of filaments is accomplished using conventional commercial equipment such as that available, for example, through Rando Machine Corporation of Macodon, N.Y., or through the former Carolina Machinery Company of Charlotte, N.C. At a bale-breaking station 22, the fiber is broken down into conveyable fiber clumps (e.g., 100 centimeters in diameter or smaller) which are next conveyed to fiber mat-forming station 24. Conveyance of the fibers can be accomplished by air conveyance, hand transport and the like. At the fiber mat-forming station 24, the clumps of fiber are further reduced and the fiber orientation is made more uniform by processing the fibers in a known manner to form a crude mat having a loft and width which are dependent on the equipment employed, machine conditions, and the type of fibers used in the manufacturing process. A typical loft for the thus formed mat is about 5 cm, and the width of the mat will vary according to the equipment being used, but generally will be within the range from about 1 meter to about 4 meters. Commercially available fiber mat-forming equipment is used at the fiber mat-forming station 24 such as that available through Rando Machine Corporation, through Dr. Otto Angleitner GmbH & Co. KG of Wells, Austria, or through the former Carolina Machine Company, for example.

A blending operation may be performed to combine a plurality of fiber types or fiber deniers, for example, into a single mat. Those skilled in the art will appreciate that blending of different fibers can be accomplished at any stage previous to the formation of the final product and the invention is not to be limited to the particular order in which the process steps of the preferred embodiment are performed, or to any particular method for combining different fibers. Referring to FIG. 4, for example, a second crude mat of fibers may be formed at second mat forming station 24' from additional fibers supplied from second bale breaking station 22'. The additional mat may be combined with the mat formed at station 24 in a known manner as a function of the respective weights or the processing speeds of the two mats.

Figure 6:
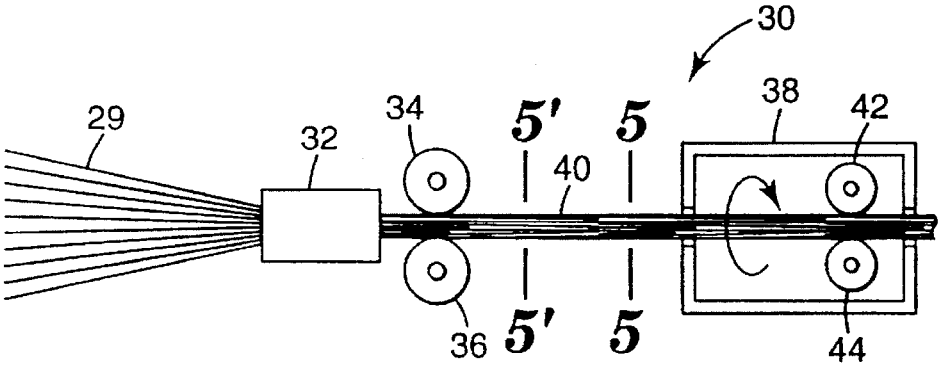
FIG. 6 is a schematic representation of the tow station portion of the process shown in FIG. 4, including equipment to carry out the various steps therein.

The mats from the stations 24 and 24' are preferably combined as a function of their respective processing speeds to achieve a blended mat which comprises a combination of the mat fibers from station 24 and the mat fibers from station 24' in a predetermined weight ratio. Processing speeds can be periodically changed to thereby adjust the weight ratio of fiber supplied from mat-forming station 24 with respect to the fiber supplied through station 24'. Continuous monitoring and adjustment of the process speeds is preferred to maintain a desired fiber ratio. Commercially available equipment may be employed to monitor the aforementioned web weights such as that available through Dr. Ernst Fehrer CG of Linz, Austria, or through Gamett Controls Ltd. of Bradford, West Yorkshire, England, for example. The aforementioned mats are combined to form a single web at card station 28 where a carded web 29 (FIG. 6) is provided in a known manner using commercially available equipment such as that available through J. D. Hollingsworth on Wheels Inc. of Greenville, S.C., or through Georgia Textile Machinery Corporation of Chatsworth, Ga., or through Marzolle International Inc. of Spartanburg, S.C., for example. The web 29 produced at station 28 will comprise an array of fibers which are somewhat oriented or arranged to extend in the machine direction due to the nature of the carding equipment and manner in which such equipment operates to form the web 29, as known by those skilled in the art.

Figure 5:
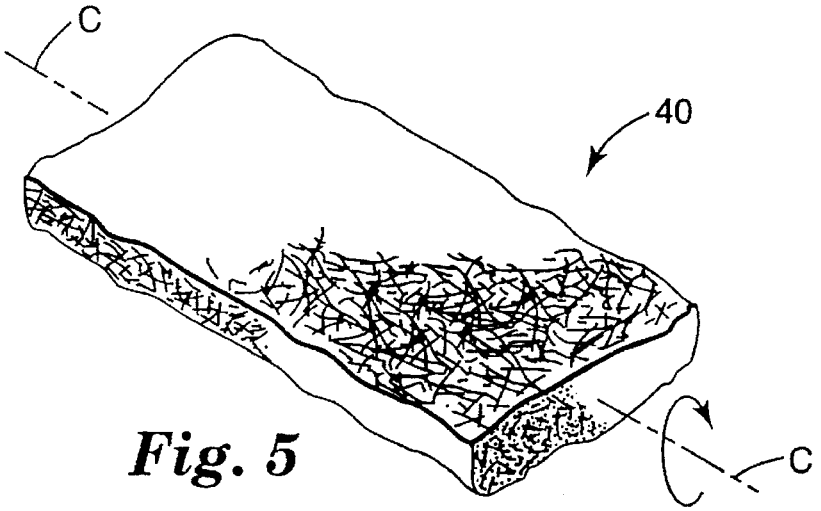
FIG. 5 is a perspective view of a tow segment taken between the line 5—5 and 5'—5' of FIG. 6.

The carded web 29 is next conveyed to the tow-forming station 30 (FIG. 6) to form a tow 40. The web 29 is initially gathered and pulled through a rotating feed tube 32 to provide a thick, loosely gathered tow 40 which is initially twisted by the tube 32 about the longitudinal axis, shown as line C—C (e.g., the machine direction), in FIG. 5. Twisting by the tube 32 at this point in the process is considered optional, but is preferred because the frictional contact between the inner surface of tube 32 and the tow 40 is believed to help intertwine at least the surface fibers of the tow to impart additional structural integrity to the body of the tow to aid in preventing breakage. The rotational speed of the tube 32 is not believed to be critical and the tube may be rotatably driven in any known manner. The tow 40 is pulled through the tube 32 by pull rollers 34 and 36 and is then pulled through coiling machine or coiler 38 by the action of the driven rollers 42 and 44 within the coiler 38. Tension is maintained along the longitudinal axis of the tow between the rollers 34 and 36 and rollers 42 and 44 by the former roller pair being run at a slightly slower speed than the latter pair. The tension in the tow 40 is preferably not sufficient to cause breakage, but is significant enough to pull the component fibers within the tow with respect to one another along the longitudinal axis C—C, further arranging or orienting the fibers therealong. The coiling machine 38 is rotatably driven in a known manner to impart a degree of twist along the axis C—C of the tow 40 (e.g., about its longitudinal axis), as indicated by the arrows in FIGS. 5 and 6. In this manner, a slubbed tow is provided which may be drawn and twisted further to provide additional strength and loft and to further adjust the fiber density, as desired. The degree of twist given to the tow by the coiler 38 will help to determine the strength of the finished articles made from the tow, such as the aforementioned hand pads and the like. The tow 40 is typically twisted at least about 180° for each 30.5 cm (1 foot) length of the tow 40. Preferably, the tow 40 is twisted more than 180° around its longitudinal axis C—C. However, it will be appreciated that a suitable balance between the strength (determined by twisting) and the loft of the finished article must be achieved because excessive twisting of the tow 40, while imparting strength, can detrimentally effect the loft of the fibers therein. The degree of twist given to a specific tow will depend on its composition, taking into account the composition of the fibers used therein, fiber deniers, staple lengths and the like. In general, a twist of about 180° has been sufficient in the manufacture of hand pads made of polyester and/or nylon fibers with fiber deniers within the range from 15 to 200 and fiber lengths between 5 and 6 cm. Commercially available coiling equipment suitable for use in the aforementioned process includes that available under the trade designation "COIL MASTER" available from J. D. Hollingsworth on Wheels Inc. of Greenville, S.C.

The thus-formed slubbed tow may now be stored for subsequent treatment at a later time. It should be noted, however, that the tow will typically begin to lose at least some degree of twist as soon as it exits the coiler 38. Consequently, storage of the tow at this point in the manufacturing process is not preferred, and the tow is next treated to adhere the fibers to one another at their mutual points of contact. Where melt bonding is employed, a heating operation (not shown) is employed next to heat the melt bondable fibers sufficiently to cause partial melting of at least some of the fibers in the slubbed tow. The tow is then cooled to obtain the desired bonding. Heating of the melt bondable fibers may be accomplished by any suitable means such as by conveying the slubbed tow through a conventional oven, by infrared heating or by providing the aforementioned rolls 42 and 44 within the coiler 38 with a suitable heat source to thereby melt the fibers as they pass between the roller 42 and 44 and at the same time the tow is twisted by the coiling machine 38. Other heating means will be apparent to those skilled in the art. Cooling of the tow may be accomplished at ambient conditions. The melt bonded slubbed tow may also be coated with a suitable adhesive which may optionally include additional abrasive particles for more aggressive scouring applications, all as described below.

The slubbed tow (with or without melt bonding) may be coated with a coatable resinous composition at a coater station 41 (FIG. 4). Application of the aforementioned resinous binder can be accomplished by any suitable means including roll coating, liquid resin spray coating, dry powder coating, suspended powder coating, powder dropping, liquid dip coating, fluidized bed powder coating, electrostatic powder coating, critical gas dilution liquid resin coating or other commonly used coating processes available to those skilled in the art. Preferably, the tow is coated using a two-roll coater such as those available from Web Processing Limited of North Stockport, Cheshire, England, and N. Schlumberger (USA) Inc. of Fort Mill, S.C.

Abrasive particles can be added to the articles of the invention, if desired, in any known manner. For example, the particles can be combined in a slurry with the coatable resinous composition prior to its application to the tow so that the above described coating step simultaneously applies the particles to the tow with the resinous composition. Alternatively, the abrasive particles can be drop-coated or electrostatically coated onto the tow after the application of the resinous composition and prior to its hardening. All of the aforementioned techniques for the application of abrasive particles are well known and are not described further. The resin is applied to the articles of the invention to provide a preferred dry weight ratio of resin to fiber. The preferred dry weight ratio of resin to fiber for more aggressive articles of the invention (e.g., those including harder abrasive particles) is preferably about 2.0. For less aggressive pads, the preferred resin to fiber ratio is about 1.0.

The resinous binder is then hardened, preferably by heat curing in a two zone oven, as described in the Examples herein. After curing, the thus-formed tow 40 (FIG. 3) may be conveyed to a cutting station where the tow is cut (e.g., by die cutting) to provide finished articles such as hand pads and the like.

It will be appreciated that the foregoing process steps may be carried out at different points in the manufacturing process and the invention is not to be limited to any particular order of process steps. For example, it is contemplated that the application of the resinous binder can be accomplished prior to the twisting of the tow or even after the tow has been cut. Other process variations will be apparent to those skilled in the art.

TEST METHODS

In the Examples which follow, the described test methods were employed.

Schiefer Cut Test

To evaluate the relative abrasiveness of articles of the present invention, articles tested were cut into circular samples approximately 8.25 centimeters in diameter. The articles were secured to the drive plate of a Schiefer Abrasion Tester (available from Frasier Precision Company of Gaithersburg, Maryland) using a plastic bristle fastener available under the trade designation "INSTA-LOK" from the Minnesota Mining and Manufacturing Company. Circular acrylic work pieces (available under the trade designation "ACRYLITE" from American Cyanamid Co.) were employed for each of the articles tested. The workpieces were all approximately 10.16 cm in diameter and about 0.317 cm thick. The initial dry weight of each workpiece was recorded and the workpiece was secured to the lower turntable of the test machine using double sided foam tape. Testing was conducted under a load of 2.26 kg for 5,000 revolutions with water applied to the surface of the acrylic disc at a rate of 40–60 drops/minute. The final weight of the workpiece was then determined and the weight loss by the acrylic disc during the test is given as the result (reported as grams per 5,000 revolutions). Results are reported for the two major surfaces ("Side 1" and "Side 2") of each of the pads tested.

Foodsoil Removal

To determine the initial effectiveness of scouring articles in the removal of carbonized foodsoil from a stainless steel disc (10.16 cm diameter×0.31 cm thick), a measured amount of a blended foodsoil composition (Table 1) was coated onto a stainless steel disc and baked for thirty minutes at 232° C. The disc was alternately coated and baked three times, weighed and then attached to the lower turntable of a Schiefer Abrasion Tester modified to accommodate the disc. A2.26 kg (5lb.) head weight was used as the applied force.

The article tested was saturated with water, centered and fastened against the upper turntable of the test machine and tested for 200, 300, 500 and 1,000 cycles under wet conditions by lubricating the disc with water at a rate of 1 drop/second. The dry weight of the disc was determined after the desired number of revolutions and the weight loss was reported for the dried disc.

TABLE 1

| Foodsoil Composition | |
|---|---|
| Amount | Component |
| 120 gm | tomato juice |
| 120 gm | cherry juice |
| 120 gm | ground beef (70% lean) |
| 60 gm | shredded cheddar cheese |
| 120 gm | whole milk |
| 20 gm | white all purpose flour |
| 100 gm | granulated sugar |
| 1 | Grade AA egg |

Dry Web Tensile Strength

The breaking strength of woven and nonwoven materials were tested using an electronic tensile tester with a 226.8 kg (500 lb) load cell. The tester employed was the Model QC-II available from Thwing-Albert Instrument Company, Philadelphia, Pa.). Test specimens were cut into rectangular samples (5.08 cm×17.78 cm) with the longer dimension oriented parallel to the direction of material manufacture (e.g., to the machine direction). Each sample was placed in the jaws of the tester, initially spaced apart at a distance of 12.7 cm, and the tester was set to pull the samples apart at a rate of 25.4 cm/min. The final loads (at yield point) were recorded for each of the tested samples.

INGREDIENTS AND ABBREVIATIONS

Abbreviations for the ingredients used in the Examples and in the Preparative Procedures are identified below.

PR1 is phenolic resin 1 comprising 2.1% free phenol, 1.9–2.2% free formaldehyde, about 70% solids and the remainder water. The resin was prepared as a resole precondensate of a 2:1 molar ratio of formaldehyde:phenol in a water solution with potassium hydroxide catalyst.

PR2 is phenolic resin 2 comprising 1.37% free phenol, less than 2% free formaldehyde, about 74% solids and the remainder water. The resin was prepared as a resole precondensate of a 2:1 molar ratio of formaldehyde:phenol in a water solution with sodium hydroxide catalyst.

A1280 is 280 grade and finer brown aluminum oxide particles which were obtained from Washington Mills Electrominerals Corporation of Niagara Falls, N.Y.

A1320 is 320 grade aluminum oxide particles which were obtained from Sunbelt Industries of Oklahoma City, Okla.

CC is calcium carbonate particles (No. 1 White) which were obtained from ECC America, Inc. of Sylacauga, Ala.

H2679 is a latex resin (acrylic ester copolymer anionic emulsion) commercially available under the trade designation "Hycar" 2679 from B.F. Goodrich of Brecksville, Ohio.

AF is an antifoaming agent commercially available under the trade designation "Q2-5169 Surfactant" from Dow Corning Corporation of Midland, Mich.

POA is a polyoxyalkyleneamine commercially available under the trade designation 75838 "Jeffamine" D-400 from Texaco Chemical Company of Houston, Tex.

HEE is hydroxyethyl ethylene urea commercially available under the trade designation "SR-511" from Sartomer Company, Inc. of Exton, Pa.

PET15 is 15 denier polyethylene terephthalate (PET) staple fiber commercially available under the trade designation "Hoechst Polyester Type 294" from American Hoechst Corporation of Somerville, N.J. having a fiber length of 5.08 cm (2 in.) with 3.74 half crimps per centimeter and a tenacity of 4.7 grams per denier.

PET15B is a 15 denier bicomponent bonding PET fiber made according to Example 1 of U.S. Pat No. 5,082,720 (Hayes et al.) having a fiber length of 5.84 cm (2.3 in.) with 3.93 half crimps per centimeter and a tenacity of 2.0 grams per denier.

PET50 is 50 denier polyethylene terephthalate staple fiber having a fiber length of 5.58 cm (2.2 in.) with 3.93 half crimps per centimeter and a tenacity of 4.0 grams per denier.

NYL58 is 58 denier staple fiber of nylon 6 having a fiber length of 5.08 cm (2.0 in.) with 4.33 half crimps per centimeter and a tenacity of 4.0 grams per denier.

BLK is a black pigment available under the trade designation "AQUA SPERSE" from Hüls America, Inc. of Piscataway, N.J.

BLU is blue pigment available under the trade designation "AQUA SPERSE" from Hüls America, Inc.

TI is a white titanium dioxide pigment available under the trade designation "AQUA SPERSE" from Hüls America, Inc.

PREPARATIVE PROCEDURES

The following preparative procedures were used in the preparation of the articles in the Examples below.

Preparative Procedure A (Slubbed Tow)

PET slubbed tow was prepared using a commercial carding system modified with a reinforced frame and a coiler ("COILMASTER"), both available from J. D. Hollingsworth, on Wheels, Inc. Of Greenville, S.C. The coiler was timed to produce tow at a rate of about 6.1 meters/minute (20 feet/min). For blends of 50 and 15 denier PET fiber blends (e.g., 70:30% and 85:15% blends of PET50 and PET15, respectively), tow weights range from 20.7 to 26.6 gm/m (350 to 450 grains per yard). For fiber blends of 85% PET50 and 15% PET15B bonding fiber, tow weights range from 22.2 to 25.2 gm/m (375–425 grains per yard).

Preparative Procedure B (Resin A)

Approximately 18.14 kg (40 lbs) of this abrasive containing resin was prepared by mixing the ingredients listed in Table 2 at moderate shear in an electric mixer (available under the trade designation "LIGHTNIN'" from the Mixing Equipment Company of Rochester, N.Y.). The phenolic resin is added first followed by water, antifoaming agent, aluminum oxide particles and then pigments. The resin mix time after all ingredients were added was approximately 10 minutes to allow for the adequate dispersion of the abrasive particles. Viscosity was measured using a Brookfield Model LV viscometer.

Preparative Procedure C (Resin B)

Approximately 18.14 kg (40 lbs) of this abrasive containing resin was prepared by mixing the ingredients listed in Table 2 at moderate shear in an electric mixer ("LIGHTNIN'" from the Mixing Equipment Company Lightnin' Company). The phenolic resin is added first followed by water, latex resin, antifoaming agent, aluminum oxide particles and then pigments. The resin mix time was approximately 10 minutes to allow for the adequate mixing of the latex and the phenolic resins and for the dispersion of the abrasive particles. Viscosity was measured using a Brookfield Model LV viscometer.

Preparative Procedure D (Resin C)

Approximately 18.14 kg (40 lbs) of this nonabrasive resin was prepared by mixing the ingredients listed in Table 2 at moderate shear in an electric mixer ("LIGHTNIN'" from the Mixing Equipment Company Lightnin' Company). The phenolic resin is added first followed by water, antifoaming agent and then pigments. The resin mix time was approximately 10 minutes. Viscosity was measured using a Brookfield Model LV viscometer.

Preparative Procedure E (Resin D)

Approximately 18.14 kg (40 lbs) of this latex modified nonabrasive resin was prepared by mixing the ingredients listed in Table 2 at moderate shear in an electric mixer ("LIGHTNIN'" from the Mixing Equipment Company Lightnin' Company). The phenolic resin is added first followed by water, latex resin, antifoaming agent and then pigments. The resin preparation time was approximately 10 minutes. Viscosity was measured using a Brookfield Model LV viscometer.

Preparative Procedure F (Resin E)

Approximately 18.14 kg (40 lbs) of this abrasive containing resin was prepared by mixing the ingredients listed in Table 2 at moderate shear in an electric mixer ("LIGHTNIN'" from the Mixing Equipment Company Lightnin' Company). The phenolic resin is added first followed by water, antifoaming agent, polyoxyalkylene amine and hydroxyethyl ethylene urea (as a plasticizer), aluminum oxide and calcium carbonate particles and then pigments. The resin preparation time was approximately 15 minutes to adequately disperse the abrasive particles. Viscosity was measured using a Brookfield Model LV viscometer.

TABLE 2

| | (Resin Preparations) | | | | |
|---|---|---|---|---|---|
| Ingredient | Resin A | Resin B | Resin C | Resin D | Resin E |
| water | 10.02% | 10.02% | 6.92% | 6.0% | 13.9% |
| TI | 3.51 | 3.51 | 4.5 | 3.87 | — |
| BLK | 0.25 | 0.25 | — | — | — |
| BLU | — | — | 0.6 | 0.6 | — |
| AF | 0.14 | 0.14 | 0.14 | 0.12 | 0.09 |

TABLE 2-continued

| | (Resin Preparations) | | | | |
|---|---|---|---|---|---|
| Ingredient | Resin A | Resin B | Resin C | Resin D | Resin E |
| PR1 | 37.07 | — | — | — | — |
| Al280 | 49.01 | 49.01 | — | — | — |
| H2679 | — | 20.76 | — | 43.22 | — |
| PR2 | — | 22.24 | 87.84 | 46.31 | 26.31 |
| Al320 | — | — | — | — | 39.39 |
| CC | — | — | — | — | 13.82 |
| POA | — | — | — | — | 2.83 |
| HEE | — | — | — | — | 3.64 |
| Total % Solids | 76 | 76 | 61.7 | 61.7 | 83.6 |
| Viscosity[1] | 2500 cps | 2500 cps | 1200 cps | 350 cps | 2500 cps |

[1]As determined on a Model LV Brookfield viscometer using spindle 3 at a speed of 12 rpm.

EXAMPLES

The following Examples illustrate the preparation, utility and the comparative advantages of articles made according to the invention. The materials and the amounts thereof, as well as the other conditions recited in the Examples, are not to be construed as unduly limiting. Unless otherwise indicated, all parts and percentages are by weight.

Example 1

A slubbed tow was prepared according to the above Preparative Procedure A using a fiber blend of 85% PET50 and 15% PET15. Approximately 18.3 meters (20 yards) of the tow was roll coated with Resin A using a two roll coater to provide a dry resin to fiber weight ratio of about 2.2. The thus coated tow was cured with two passes through a two zone oven having a temperature in the first zone between 105° C. and 127° C. and in the second zone between 146° C. and 150° C. The effective oven length was split between the two zones with the first zone comprising about 60% of the effective length and the second zone comprising the remaining 40%. The residence time for one pass through the oven was about 4 minutes and the cured tow was cut to provide scouring pads of 6.98 cm (2.75 inches) in length with an average coated pad weight of about 7.43 grams.

Example 2

Slubbed tow was prepared as in Example 1 except that Resin B was used and the dry resin to fiber weight ratio was about 1.95. The resin was cured with one pass through the oven having a temperature in zone 1 of 137° C. and a temperature in zone 2 of 146° C. The residence time in the oven was about 10 minutes and the average coated pad weight of the resulting pads was 6.21 grams.

Example 3

Slubbed tow was prepared as in Example 1 except that Resin C was used and the dry resin to fiber weight ratio was about 0.96. The resin was cured with one pass through the oven having a temperature in zone 1 of 127° C. and a temperature in zone 2 of 146° C. The residence time in the oven was about 10 minutes and the average coated pad weight of the resulting pads was 4.55 grams.

Example 4

Slubbed tow was prepared as in Example 1 except that Resin D was used and the dry resin to fiber weight ratio was about 0.81. The resin was cured with one pass through the oven having a temperature in zone 1 of 124° C. and a temperature in zone 2 of 147° C. The residence time in the oven was about 10 minutes and the average coated weight of the resulting pads was 3.82 grams.

Example 5

Slubbed tow was prepared as in Example 1 except that a fiber blend of 70% PET50 and 30% PET15 was used. The dry resin to fiber weight ratio was about 2.5. The average coated weight of the resulting pads was 7.53 grams.

Example 6

Slubbed tow was prepared as in Example 5 except that Resin B was used, and the dry resin to fiber weight ratio was about 2.2. The binder was cured in one pass through a two zone oven with the temperature in zone 1 at 124° C. and the temperature in zone 2 at 147° C. The residence time for a single pass through the oven was about 10 minutes, and the average coated weight of the resulting pads was 6.15 grams.

Example 7

Slubbed tow was prepared as in Example 5 except that Resin C was used, and the dry resin to fiber weight ratio was about 0.96. The binder was cured in one pass through a two zone oven with the temperature in zone 1 at 127° C. and the temperature in zone 2 at 146° C. The residence time for a single pass through the oven was about 10 minutes, and the average coated weight of the resulting pads was 4.61 grams.

Example 8

Slubbed tow was prepared as in Example 5 except that Resin D was used, and the dry resin to fiber weight ratio was about 0.81. The binder was cured in one pass through a two zone oven with the temperature in zone 1 at 124° C. and the temperature in zone 2 at 147° C. The residence time for a single pass through the oven was about 10 minutes, and the average coated weight of the resulting pads was 3.93 grams.

Example 9

Slubbed tow was formed as in Example 1 except that 85% PET50 and 15% PET15B were used, and the dry resin to fiber weight ratio was about 2.2. The coated tow was cured in two passes through a two zone oven with the temperature in zone 1 at 137° C. and the temperature in zone at 178° C. The residence time for one pass through the oven was 4 minutes, and the average coated weight of the resulting pads was 6.64 grams.

Example 10

Slubbed tow was formed as in Example 9 except that Resin B was used, and the dry resin to fiber weight ratio was about 1.9. The coated tow was cured in one pass through a two zone oven with the temperature in zone 1 at 124° C. and the temperature in zone at 147° C. The residence time through the oven was about 10 minutes, and the average coated weight of the resulting pads was 5.97 grams.

Example 11

Slubbed tow was formed as in Example 9 except that Resin C was used, and the dry resin to fiber weight ratio was about 1.0. The coated tow was cured in one pass through a two zone oven with the temperature in zone 1 at 127° C. and the temperature in zone at 146° C. The residence time through the oven was about 10 minutes, and the average coated weight of the resulting pads was 4.23 grams.

Example 12

Slubbed tow was formed as in Example 9 except that Resin D was used, and the dry resin to fiber weight ratio was about 0.81. The coated tow was cured in one pass through a two zone oven with the temperature in zone 1 at 124° C. and the temperature in zone at 147° C. The residence time through the oven was about 10 minutes, and the average coated weight of the resulting pads was 3.91 grams.

Example 13

Slubbed tow was prepared as in Example 1 except that a fiber blend of 70% PET50 and 30% PET15 was used. The tow was roll coated with Resin A to give a dry resin to fiber weight ratio of about 2.41. The thus coated tow was cured in two passes of a two zone oven with the temperature in the first zone at 137° C. and the temperature in the second zone at 178° C. The residence time for each pass through the oven was 4 minutes and the average coated weight of the resulting pads was 5.4 grams.

Example 14

Slubbed tow was formed as in Example 13 except that Resin B was used, and the dry resin to fiber weight ratio was about 2.15. The coated tow was cured in one pass through a two zone oven with the temperature in zone 1 at 124° C. and the temperature in zone at 147° C. The residence time through the oven was about 10 minutes, and the average coated weight of the resulting pads was 4.75 grams.

Example 15

Slubbed tow was formed as in Example 13 except that Resin C was used, and the dry resin to fiber weight ratio was about 0.96. The coated tow was cured in one pass through a two zone oven with the temperature in zone 1 at 127° C. and the temperature in zone at 146° C. The residence time through the oven was about 10 minutes, and the average coated weight of the resulting pads was 3.03 grams.

Example 16

Slubbed tow was formed as in Example 13 except that Resin D was used, and the dry resin to fiber weight ratio was about 0.81. The coated tow was cured in one pass through a two zone oven with the temperature in zone 1 at 124° C. and the temperature in zone at 147° C. The residence time through the oven was about 10 minutes, and the average coated weight of the resulting pads was 2.88 grams.

Example 17

A slubbed tow was formed according to the Preparative Procedure A using a fiber blend of 70% NYL58 and 30% 15 PET15 fibers. A lighter tow was prepared at a web weight of 26.6 gm/m (450 grains per yard). Approximately 18.2 meters (20 yards) of the tow was roll coated with a two roll coater using Resin E to provide a dry resin to fiber weight ratio of about 2.6. The tow was cured in two passes each through a two zone oven with the temperature in the both zones at 150° C. The residence time for one pass through the oven was about 10 minutes. The cured tow was die cut into circular scouring pads 8.25 cm (3.25 inches) in diameter with an average coated pad weight of 8.33 grams.

Example 18

Pads were prepared as in Example 17 except that the tow was heavier with a web weight of 42.5 gm/m (600 grains per yard). The dry resin to fiber weight ratio was about 2.0. and the average coated pad weight was 8.60 grams.

Example 19

Slubbed tow was prepared according to the Preparative Procedure A using 70% PET50 and 30% PET15 and a tow weight of about 25.23 gm/m (356 grains/yard). The tow was ultrasonically welded at 7 cm intervals along its length using a "Bronson" sonic sealer available from the Bronson Sonic Power Company of Danbury, Conn. The tow was cut along the welded areas to form pads 7 cm in length, 6.5 cm in width having a loft depth of about 3.8 cm along the midline of each pad. The weld on the ends of the pads were about 1 mm in depth. The pads of this Example were prepared using the sonic welding technique disclosed in U.S. Pat. No. 5,025,096.

A comparison was made of the pads of Example 19 with the pads of the Comparative Examples B and E, described below (both made according to the teaching of the '096 Patent). On an equivalent fiber weight basis, the pads of Example 19 were observed to have more loft and were generally larger than the pads of either of the Comparative Examples.

Comparative Example A

Commercially available scouring pads were used as Comparative Example A in the testing below. The pads comprised a nonwoven substrate with a web weight of about 155 gm/m$^2$ with 240/F grade alumina abrasive particles adhered to the web. The dry coating weight ratio of resin to fiber was about 3:1. These scouring pads are commercially available under the trade designation "Scotch-Brite" No. 96 from the Minnesota Mining and Manufacturing Company of St. Paul, Minn.

Comparative Example B

Commercially available scouring pads available under the trade designation "Never Rust" from the Minnesota Mining and Manufacturing Company were used as Comparative Example B. These pads comprise a nonwoven web made from a continuous tow as described in U.S. Pat. No. 5,025,096, with a fiber weight of about 21.5 gm/m having 240/F grade alumina abrasive particles adhered to the web. The dry coating weight ratio of the resin coating to the fiber was about 2.55:1.

Comparative Example C

Commercially available steel wool scouring pads available under the trade designation "S.O.S." from Clorox Corporation of Oakland, Calif.

Comparative Example D

Commercially available light duty scouring articles available under the trade designation "Soft Scour" from the Minnesota Mining and Manufacturing Company were used as Comparative Example D in the comparative testing below. These pads comprise a nonwoven web with a fiber weight of about 410 gm/m$^2$ having organic polymeric (polyvinylchloride) abrasive particles adhered to the web. The dry coating weight ratio of the resin coating to the fiber was about 1.9:1.

Comparative Example E

Commercially available scouring articles available under the trade designation "Never Scratch" from the Minnesota Mining and Manufacturing Company were used as Comparative Example E. These pads were suited for more light duty abrasive applications were selected for the comparative testing below. These pads comprise a nonwoven web made from a continuous tow as described in U.S. Pat. No. 5,025,096, with a fiber weight of about 21.5 gm/m and having no abrasive particles adhered to the web. The dry coating weight ratio of the resin coating to the fiber was about 1.3:1.

COMPARATIVE TESTING (AGGRESSIVE PADS)

Pads of Examples 1, 5, 6, 9, 10, 13, 14, 17 and Comparative Examples A–C were considered well suited for aggressive scouring or other surface treatment applications and were comparatively tested in more aggressive abrasive applications by the Schiefer Cut Test and in a less aggressive scouring applications by the Foodsoil Removal Test (except for the pads of Examples 13 and 14). The test data is set forth in Table 3 for the Shiefer Cut and in Table 4 for the Foodsoil Removal.

TABLE 3

| | (Schiefer Cut) | |
|---|---|---|
| Example | Cut (grams) Pad side 1 | Cut (grams) Pad side 2 |
| Comparative A | 3.25 | 2.81 |
| Comparative B | 1.32 | 0.9 |
| Comparative C | 0.08 | — |
| 1 | 1.8 | 1.71 |
| 5 | 1.78 | 1.53 |
| 6 | 1.76 | 1.77 |
| 9 | 2.22 | 1.86 |
| 10 | 1.92 | 1.84 |
| 13 | 1.78 | 1.84 |
| 14 | 1.9 | 1.92 |
| 17 | 2.42 | 1.85 |

TABLE 4

| | (Foodsoil Removal) | | |
|---|---|---|---|
| Example | weight loss (gms) 200 cycles | weight loss (gms) 300 cycles | weight loss (gms) 500 cycles |
| Comparative A | 0.66 | 0.93 | 1.01 |
| Comparative B | 0.24 | 0.32 | 0.46 |
| Comparative C | 0.47 | — | 0.73 |
| 1 | 0.29 | 0.35 | 0.46 |
| 5 | 0.23 | 0.33 | 0.46 |
| 6 | 0.29 | 0.27 | 0.38 |
| 9 | 0.29 | 0.35 | 0.53 |
| 10 | 0.29 | 0.39 | 0.58 |
| 17 | 0.4 | 0.54 | 0.68 |

The above data for the Schiefer Cut demonstrates that the above tested articles of the invention are at least as abrasive as the prior art Comparative Examples. The higher cut values for the pad of Comparative A is attributed to its higher loading of abrasive particles. The pads of the inventive Examples were clearly at least as effective and often more effective than the scouring article of Comparative B and were far superior to the steel wool pad of Comparative Example C. Similar results were obtained in the above Foodsoil Removal Test with the pads of the Examples performing comparably to the pads of the Comparative Examples in their food removal ability. The inventive pad of Example 17 performed as well as the steel wool pad of Comparative Example C from the initial cut (200 cycles) through the final cut (500 cycles). These excellent scouring results were obtained for the inventive pads while the pads were manufactured more cost efficiently with a less complex manufacturing process than the process employed for the pads of Comparative Example B, for example.

COMPARATIVE TESTING (LIGHT DUTY PADS)

Pads of Examples 4, 11, 12, 16 and Comparative Examples D and E were all considered well suited for light duty scouring applications and were comparatively tested for Foodsoil Removal. The data is set forth in Table 5.

TABLE 5

| | (Foodsoil Removal) | | |
|---|---|---|---|
| Example | weight loss (gms) 200 cycles | weight loss (gms) 500 cycles | weight loss (gms) 1000 cycles |
| Comparative D | 0.29 | 0.46 | 0.56 |
| Comparative E | 0.08 | 0.18 | 0.25 |
| 4 | 0.08 | 0.16 | 0.26 |
| 16 | 0.08 | 0.14 | 0.26 |
| 11 | 0.14 | 0.28 | 0.42 |
| 12 | 0.09 | 0.2 | 0.31 |

The data show that the inventive pads of the Examples are as effective as the light duty prior art pads in the removal of foodsoil. The higher values obtained for the pad of the Comparative D is attributed to its heavier binder coating and the presence of abrasive particles in the binder coating for these articles. However, the overall results after 1000 cycles demonstrates that the inventive pads are as effective and durable as the prior art pads of the Comparative Examples. All of the pads of the Examples were as good or better than those of Comparative E from the initial measurement at 200 cycles through the measurement at 1000 cycles, showing initial equivalent cleaning performance for the pads of the invention at lower overall pad weights.

COMPARATIVE TESTING (TENSILE STRENGTHS)

Comparative data was collected for dry tensile strength for the pads of Examples 1, 6, 9, 10 and Comparative Example A. The data for downweb (e.g., in the machine direction) and crossweb is set forth in Table 6

TABLE 6

| | (Tensile Strengths) | | |
|---|---|---|---|
| Example | Tensile Strength Downweb (Newtons/cm width) | Tensile Strength Crossweb (Newtons/cm width) | Ratio of Tensile Strength Downweb/ Crossweb |
| Comparative A | 26.29 | 21.87 | 1.2 |
| 1 | 133.12 | 22.95 | 5.8 |
| 6 | 128.7 | 20.60 | 6.2 |
| 9 | 106.83 | 23.05 | 4.6 |
| 10 | 126.94 | 34.43 | 3.7 |

The tensile data demonstrates the differences in the downweb and crossweb tensile strengths for the inventive pads of the Examples compared with the nearly equivalent tensile strengths for the nonwoven pad of Comparative A. The ratios of the downweb/crossweb tensile strengths for the Comparative Example A is slightly more than 1.0 while the ratios for the pads of the inventive Examples are all greater than 2.0 with the pad of Example 6 having a ratio greater than 6.

Although the preferred embodiment of the invention has been described in some detail, those skilled in art will understand that the foregoing description is merely illustrative is not to be construed as limiting in any way. Changes and modifications to the described embodiment can be made without departing from the true spirit and scope of the invention, as defined in the following claims.

We claim:

1. An article useful in cleaning, scouring, polishing and other surface conditioning applications, comprising:

A bundle of discontinuous fibers bonded to one another at points of mutual contact, said fibers arranged within said bundle to provide a dense longitudinal central portion extending to opposite ends of said bundle, less dense side portions, a longitudinal tensile strength and a transverse tensile strength, wherein the longitudinal tensile strength is greater than the transverse tensile strength.

2. The article as defined in claim 1 wherein said fibers comprise materials selected from the group consisting of polyamide, polyolefin, polyester, cotton, rayon, kenaf, cellulose, metal and combinations of the foregoing.

3. The article as defined in claim 2 wherein said polyamide is selected from the group consisting of polycaprolactam, polyhexamethylene adipamide and combinations thereof.

4. The article as defined in claim 2 wherein said polyolefin is selected from the group consisting of polypropylene, polyethylene and combinations thereof.

5. The article as defined in claim 2 wherein said polyester is polyethylene terephthalate.

6. The article as defined in claim 1 further comprising a hardened resinous binder coated over said fibers.

7. The article as defined in claim 6 further comprising abrasive particles adhered to said fibers by said binder, said particles selected from the group consisting of flint, silica, pumice, calcium carbonate, polyester, polyvinylchloride, methacrylate, methylmethacrylate, polycarbonate, polystyrene, aluminum oxide, silicon carbide, alumina zirconia, diamond, ceria, cubic boron nitride, garnet, and combinations of the foregoing.

8. The article as defined in claim 7 wherein said abrasive material has a Mohs' hardness greater than 1 and an average particle size within the range from about 4.0 to about 300 microns.

9. The article as defined in claim 6 wherein said resinous binder is a phenolic resin comprising between about 1.0% (by weight) and about 2.5% free formaldehyde, between about 1.0% and about 2.5% free phenol, between about 65% and 75% solids with the remainder water, said resin prepared as a resole precondensate of a 2:1 molar ratio of formaldehyde:phenol in a water solution with a catalyst selected from the group consisting of sodium hydroxide and potassium hydroxide.

10. The article as defined in claim 1 wherein said fibers are melt bonded to one another within said bundle.

11. The article as defined in claim 1 wherein said fibers are crimped and have a denier within the range from 1.5 to 400.

12. The article as defined in claim 1 wherein said fibers are further arranged within said bundle such that the loft of said bundle is greater along said central portion than at said side portions.

* * * * *